United States Patent [19]

Berger

[11] Patent Number: 4,889,088

[45] Date of Patent: Dec. 26, 1989

[54] FLUID FLOW CONTROL METHOD AND APPARATUS FOR A POSITIVE DISPLACEMENT ENGINE OR COMPRESSOR

[75] Inventor: Michel Berger, Castelnau de Medoc, France

[73] Assignee: Pradom Limited, London, England

[21] Appl. No.: 284,655

[22] Filed: Dec. 15, 1988

[30] Foreign Application Priority Data

Dec. 16, 1987 [FR] France ..... 87 17594

[51] Int. Cl.[4] ..... F01L 3/00

[52] U.S. Cl. ..... 123/188 B; 123/193 P; 123/79 R

[58] Field of Search ..... 123/193 P, 193 CP, 47 R, 123/56 BC, 188 B, 79 R, 65

[56] References Cited

U.S. PATENT DOCUMENTS

| | | | |
|---|---|---|---|
| 3,597,121 | 8/1971 | McClocklin | 417/400 |
| 4,098,238 | 7/1978 | Vallejos | 123/79 R |
| 4,119,077 | 10/1978 | Vallejos | 123/79 R |
| 4,218,994 | 8/1980 | Reed | 123/188 B |
| 4,359,022 | 11/1982 | Nakamura et al. | 123/188 BA |
| 4,359,027 | 11/1982 | Scharpf | 123/193 CP |
| 4,523,557 | 6/1985 | Fox | 123/193 P |
| 4,709,621 | 12/1987 | Matsui et al. | 123/193 P |
| 4,715,336 | 12/1987 | Schindler et al. | 123/56 BC |

FOREIGN PATENT DOCUMENTS

| | | |
|---|---|---|
| 383712 | 10/1931 | Belgium . |
| 396670 | 4/1909 | France . |
| 424669 | 5/1911 | France . |
| 1474890 | 2/1967 | France . |
| 1573321 | 7/1969 | France . |
| 2184209 | 12/1973 | France . |
| 2417636 | 9/1979 | France . |
| 2604477 | 4/1988 | France . |
| 2608210 | 6/1988 | France . |
| 17216 | 1/1985 | Japan . |
| 2170860 | 8/1986 | United Kingdom . |

*Primary Examiner*—E. Rollins Cross

*Attorney, Agent, or Firm*—Schroeder & Siegfried

[57] ABSTRACT

A fluid control apparatus and method for a positive displacement engine or compressor which has a treatment chamber that communicates with a fluid admission duct and an exhaust duct via a port, and contains a piston within the treatment chamber which reciprocates between a top dead center and a bottom dead center position. The piston carries a poppet valve sealing member which is activated to provide substantially perfect sealing between the port and the treatment chamber when the piston is in the immediate vicinity of top dead center position, and is deactivated when the piston is in a position other than the immediate vicinity of the top dead center position in order to allow fluid to pass freely through the port.

21 Claims, 2 Drawing Sheets

FLUID FLOW CONTROL METHOD AND APPARATUS FOR A POSITIVE DISPLACEMENT ENGINE OR COMPRESSOR

The invention relates to a fluid flow control method and apparatus for a positive displacement engine or compressor.

More particularly, the invention relates essentially to a method and apparatus for forcing the flow of a fluid via a piston treatment chamber, including sealing means providing substantially perfect sealing at top dead center. The invention also relates to an engine, to a compressor, and to equipment that operates by pulses, and including an application of the method or the apparatus, and also to sealing means, in particular a valve member per se.

BACKGROUND OF THE INVENTION

French patent specification FR-A-No. 1 474 890 describes an apparatus for forcing the flow of fluid from an admission duct to an exhaust duct via a treatment chamber capable of including compression, e.g. by means of a piston 4. The apparatus includes a fluid flow control member 8 mounted to rotate in a cylinder head A which includes at least three non-aligned ports communicating with one another, including an admission port 6 in free communication with the admission duct, an intermediate port 5 in free communication with the treatment chamber, and an exhaust port 7 in free communcation with the exhaust duct. The fluid flow control member 8 rotates and includes an opening 9 which gives the treatment chamber access to only one of the ducts at a time as it rotates (see FIGS. 1 to 5).

The fluid flow control member 8 is driven with continuous rotation under all circumstances and is disposed in the cylinder head in such a manner as to ensure perfect sealing by friction between the treatment chamber and the admission and exhaust ducts (page 1, lines 17 to 25). Sealing may be reinforced by fitting segments 10.

According to said document, said apparatus is used for gas admission and exhaust in spark ignition engines, with the treatment chamber then constituting a combustion chamber containing a conventional internal combustion engine piston 4.

The cylinder head is also provided with a port for insertion of a spark plug 11. It is specified that the apparatus is entirely suitable for internal combustion engines, two strokes, diesels, and engines using any type of fuel (page 2, lines 7 to 9).

French patent specification FR-A-No. 2 090 414 describes a similar fluid flow control apparatus in which the cylinder head (7) is made up of two portions enabling the entire assembly to be machined, which portions are independently clamped into place, with the cylinder head being made of special aluminum, while the shaft (1) and the rings (2 and 8) are specially shaped so as to reduce the coefficient of friction to a minimum and so as to solve problems of expansion.

French patent specification number FR-A-2 184 209 relates to another similar fluid flow control apparatus equally applicable to (spark ignition) internal combustion engines and to compressors or pumps. It is emphasized therein that in apparatus performing the same functions, the systems used (valves controlled by cam shaft(s) often via several intermediate components) slow down fluid flow by constituting obstacles to the passage of fluid into that one of the chambers in the cylinder head which is open to the outside. In addition, the reciprocating motion of such systems constitutes considerable inertia reducing overall efficiency and putting a limit on maximum speed, while the repeated shocks constitute a risk of said components being damaged (page 1, lines 4 to 12).

The use of rotary fluid flow control apparatus serves to avoid these drawbacks and the component parts can be treated so as to be capable of operating in a corrosive medium, thereby making it possible to limit pollution from spark ignition engines by accepting a leaner mixture so as to reduce the quantity of carbon monoxide emitted.

French patent specification FR-A- No. 2 417 636 describes another rotary fluid flow control apparatus used in four stroke engines and completely similar to a fluid flow control component caused to rotate continuously about a horizontal axis perpendicular to the engine cylinder axis.

French patent specification FR-A-No. 1 573 321 describes an internal combustion engine and a discontinuously rotating fluid flow control apparatus using a discontinuous rotary drive system based on a Maltese cross. Such a device has not given rise to practical applications because of the impossibility of obtaining the required sealing and a sufficient speed of rotation with the metals or alloys used for making such engines.

Attempts have been made to improve sealing, for example by having a counterpressure shoe which receives pressure proportional to the pressure in the cylinder as described in FR-A-No. 429 121.

Another solution proposed by Japanese patent specification JP-A-No. 60-17 216 consists in making a rotary fluid flow control valve having a fixed portion 6 and a rotary portion 12 both of which are made of ceramics in order to limit thermal expansion and thus limit loss of sealing. In addition, this solution makes it possible to obtain low friction so there is no need to use a lubricant.

Other solutions have been proposed by the present inventor and constitute the subject matter of several patent applications, in particular the following French patent applications: FR-No. 86 13 525, FR-No. 86 17 438, and FR-No. 86 17 440. In these prior documents by the present inventor, a particularly advantageous application relates to engines, said engines being made of a special ceramic having characteristics of high strength at high speeds of rotation and also having resistance to thermal shock, giving a lifetime which is considerably increased relative to prior ceramics.

Further, in application FR-No. 86 13 525, the inventor describes a discontinuously rotating system in which the system is stationary for 80% of the period of rotation. Such solutions proposed by the present inventor are particularly suitable for engines in which the pistons and the cylinders are oval in shape because of the high level of kinetic and mechanical efficiency of such a system.

However, a major drawback of prior art fluid flow control systems and particularly of rotary control systems lies in lack of sealing when the piston is at top dead center or in the vicinity of top dead center, and in particular at the end of the compression cycle and above all at the moment of expansion on ignition at the precise instant when a shock wave gives rise to a pressure which, in some cases, may be as much as 100 to 150 times the compression ratio, which level is reached in diesel engines.

An object of the present invention is therefore to solve the novel technical problem consisting in supplying a solution which makes it possible to provide substantially perfect sealing in all types of fluid flow control including a treatment chamber which may contain compression and in which a piston reciprocates, when the piston is at top dead center or in the vicinity of top dead center.

Another object of the invention is to solve the novel technical problem consisting in providing a solution making it possible to provide substantially perfect sealing at top dead center or in the vicinity of top dead center of pistons in internal combustion engines, or in piston compressors, or in equipment that operates by pulses, in particular pulse jets.

Another object of the invention is to solve the novel technical problem consisting in providing a solution making it possible to ensure substantially perfect sealing at top dead center or in the vicinity of top dead center with a piston reciprocating in a treatment chamber, said method being equally applicable to conventional two or four stroke engines and to diesel engines, and preventing any mixture taking place between fresh gas being admitted and burnt gas being exhausted, thus preventing any exhaust gas from penetrating into the admission circuit.

Another object of the invention is to solve the novel technical problem consisting in providing a solution making it possible to obtain substantially perfect sealing at top dead center at the end of the exhaust stroke and prior to admission in internal combustion engines, said sealing requiring no greasing nor any adjustment and having no possibility of degrading over time, said sealing thus being incapable of coming out of adjustment regardless of the speed of rotation or the compression ratio, and additionally being very simple.

All of these technical problems are solved for the first time by the present invention in a manner which is particularly simple and useable on an industrial scale.

SUMMARY OF THE INVENTION

Thus, in a first aspect, the present invention provides a method of controlling the forced flow of a fluid from at least one admission duct to at least one exhaust duct via a treatment chamber capable of including compression, said treatment chamber including at least one port communicating selectively with said admission duct and with said exhaust duct, and a piston reciprocating in said chamber between a position which is furthest from said port commonly referred to as bottom dead center and a position closest to said port commonly referred to as top dead center, wherein sealing means are provided suitable for ensuring substantially perfect sealing between said port and said chamber at top dead center of said piston and in the vicinity of top dead center; said sealing means being activated at an appropriate moment for ensuring sealing at top dead center or in the vicinity of top dead center, and said sealing means being deactivated other than in the vicinity of top dead center in order to allow said fluid to pass through said port.

In a particularly advantageous implementation of this method, said sealing means are activated immediately before top dead center and said sealing means are deactivated immediately after top dead center.

In another particularly advantageous implementation of the method of the invention, said sealing means are carried by the piston and are advantageously directed towards said opening.

In a preferred embodiment, the sealing means are constituted by a valve member, preferably of the poppet or mushroom type.

An advantageous implementation consists in said valve member including a stem which is mounted to move in translation in a cavity in the head of the piston, and preferably in translation coaxially with the axis of the piston.

In a second aspect, the present invention also provides apparatus for controlling the forced flow of a fluid from at least one admission duct to at least one exhaust duct via a treatment chamber capable of including compression, said treatment chamber including at least one port communicating selectively with said admission duct and with said exhaust duct, and a piston reciprocating in said chamber between a position which is furthest from said port commonly referred to as bottom dead center and a position closest to said port commonly referred to as top dead center, the apparatus including sealing means selectively activated to ensure substantially perfect sealing at top dead center of said piston or in the vicinity of top dead center, or deactivated to allow said fluid to pass freely through said port in order to enter or leave said chamber other than at top dead center.

In a particular embodiment of said apparatus, the sealing means are carried by the piston.

In a particularly advantageous embodiment, the sealing means comprise a valve member, preferably of the poppet or mushroom type.

In another particularly advantageous embodiment, said valve member includes a stem which is mounted to move in translation in a cavity in the head of the piston, and preferably in translation coaxial with the axis of the piston. Unidirectional thrust means are advantageously disposed in the cavity in order to urge the valve member permanently towards said port.

In a preferred embodiment, said valve member is made of a structural ceramic. One embodiment of said valve using a structural ceramic consists in using a composite structural ceramic comprising a matrix which is reinforced with fibers that may be directed in two or three dimensions. For fibers directed in two dimensions, the composite ceramic material may be prepared by the method described in prior French patent application No. FR-84-14 800 which is incorporated herein by reference. For fibers woven in two dimensions, the fibers are advantageously selected from the group constituted by: silicon carbide; zirconium; alumina; and mixtures of aluminum oxide and silicon oxide ($Al_2O_3$-$SiO_2$). The matrix in which the fibers are embedded is advantageously selected from the group constituted by: zirconium ($ZrO_2$); alumina ($Al_2O_3$); and mixtures of aluminum oxide and of silicon oxide ($Al_2O_3$-$SiO_2$).

If the fibers are directed in three dimensions, the composite ceramic may be prepared using the method described in prior French patent application No. FR-85-19 436. The fibers woven in three dimensions are advantageously selected from: silicon carbide; a mixture of titanium carbide and silicon carbide; boron; and carbon; whereas the matrix may advantageously be made of silicon carbide, graphite, or carbon, or even zirconium oxide ($ZrO_2$).

It is also possible to use composite ceramics reinforced by fibers extending in one direction only and of the same nature as those specified above for fibers extending in two dimensions or in three dimensions.

In another advantageous embodiment, the head of the piston has a bulge projecting into the inside of the piston in order to receive the stem of the valve member.

In another particularly advantageous embodiment, the above-mentioned treatment chamber is oval in section, it receives a piston which is also oval in section, and said port is likewise oval in section and the corresponding valve member is also oval in section.

In yet another aspect, the present invention extends to engines, in particular two stroke or four stroke engines, running on gasoline or on diesel, and advantageously to engines having rotary fluid flow control, the invention also extends to piston compressors and to equipment that operates in pulses, in particular pulse jets, fitted with fluid flow control apparatus as defined above.

In a fourth aspect, the present invention provides sealing means, in particular a valve member, as defined above.

It will be understood that the present invention solves all of the technical problems specified above and obtains corresponding unexpected determining technical advantages.

The invention makes it possible to provide a moment of total and accurate sealing at the top dead center position of the piston, and this is of major importance, particularly in internal combustion engines at maximum compression and at the moment when the shock wave is initiated.

In addition, by virtue of the invention, there is no risk of a burning effect as happens with conventional exhaust valve heads. Further, the hot and corrosive exhaust gases never sweep over the heads and the stems of the valve members during the exhaust cycle, thereby ensuring that the geometrical shape of the valve head remains unaltered throughout the lifetime of the engine.

No greasing is required and no adjustment needs to be done, and in addition, there is no possibility of characteristics drifting over time, regardless of whether the engine is a four stroke or a two stroke engine.

The compression ratio remains exactly constant throughout the lifetime of the engine since hot and corrosive exhaust gases never sweep over the valve member.

By virtue of the presence of these sealing means, and in particular as implemented in the form of a valve member, the total piston area on which the gas acts at the moment of expansion is greater than for a normal piston, thereby increasing the thermal efficiency of the engine. This total area is defined as being the area of the piston plus the area of the valve member minus the cross-sectional area of the valve stem.

The invention can be used in engines which already include conventional valves, with the valve member of the invention thus providing additional thrust against the exhaust valve heads.

BRIEF DESCRIPTION OF THE DRAWINGS

An embodiment of the invention is described by way of example with reference to the accompanying drawings, in which.

MORE DETAILED DESCRIPTION

Figure 2:
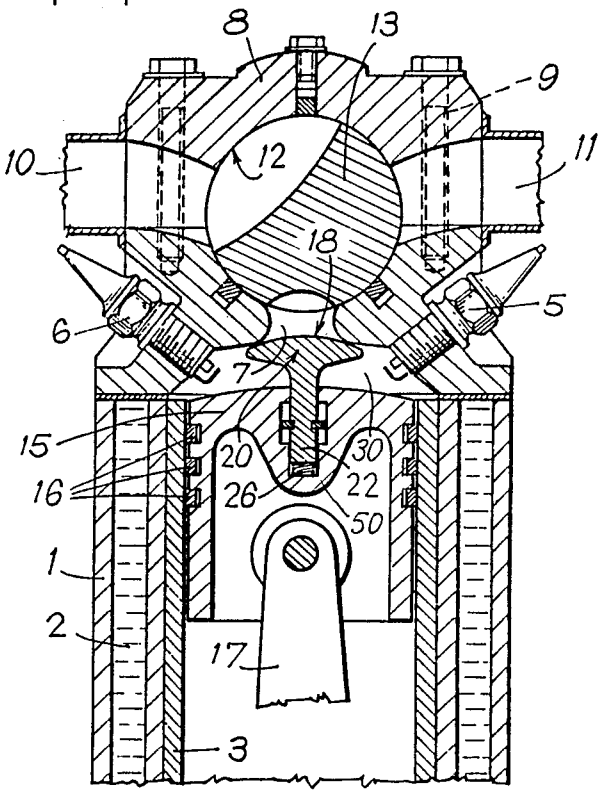
FIG. 2 is a view similar to FIG. 1 showing the piston at top dead center.
Figure 1:
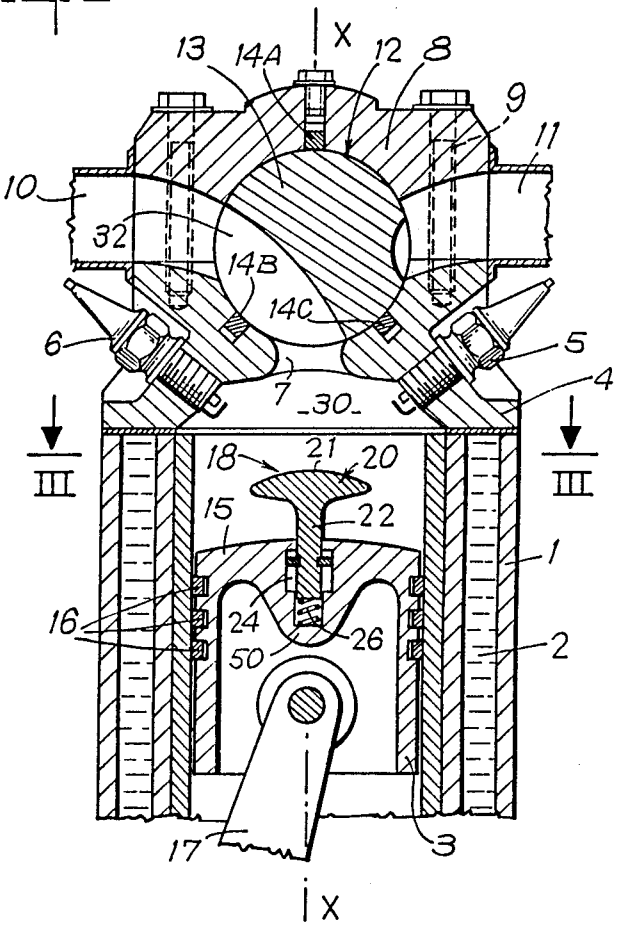
FIG. 1 is a vertical axial section view through fluid flow control apparatus in accordance with the invention used for controlling the flow of fluid in an internal combustion chamber fitted with a discontinuous rotary fluid flow control element, the engine being a four stroke engine in this case and its components being advantageously made of ceramic material, and with the treatment chamber, in this case a combustion chamber, being oval in section and containing two spark plugs and a piston which is oval in section, the section of the figure being on line I—I of FIG. 3 and the piston being shown at an intermediate position between top dead center and bottom dead center.

With reference to FIGS. 1 to 4, and more particularly with reference to FIGS. 1 and 2, a conventional engine cylinder block 1 includes openings referenced 2 through which a cooling liquid flows. The internal liners are referenced 3 and define a treatment chamber 30 which in this case constitutes a combustion chamber in which an explosion takes place.

On top of this engine block there is a cylinder head which is advantageously made of ceramic in the form of a bottom half cylinder head 4 and a top half cylinder head 8. Spark plugs 5 and 6 are disposed in the bottom half cylinder head 4 and it also has a port 7 for providing communication between the treatment chamber 30 and either the admission duct 10 or the exhaust duct 11.

The top half cylinder head 8 is fixed on the bottom half cylinder head 4 by appropriate fixing means, e.g. bolts 9. Together the top and bottom half cylinder heads 8 and 4 define through paths for the admission duct 10 and the exhaust duct 11, and also a central cylindrical bore 12 of circular section about a horizontal axis, intersecting the axis of the treatment chamber 30 and contained in its plane of symmetry. A fluid flow control element 13 is received in the circular section bore 12 and is advantageous as described in the Applicant's prior French patent application Nos. FR-86-13 525 and FR-86-13 438 which are hereby incorporated by reference.

This fluid flow control element 13 thus includes a port 32 which puts the treatment chamber 30 selectively into communication either with the admission duct 10 as shown in FIG. 1 or else with the exhaust duct 11, with FIG. 2 showing an intermediate position. Between these two half-cylinder heads 4 and 8 and the rotary fluid flow control element 13 which may advantageously be caused to rotate discontinuously as described in FR-86-13 525, it is advantageous to place sealing centering segments respectively referenced 14A, 14B, and 14C.

The fluid flow control element 13 and the cylinder head constituted by the two half cylinder heads 4 and 8 are advantageously made of an appropriate ceramic of the technical structural type based on a metal oxide and reinforced with fibers giving rise to a composite ceramic or to a ceramicceramic as described in the above-specified prior applications of the present Applicant.

A piston 15 is disposed inside the treatment chamber 30 and carries conventional sealing segments 16. The piston 15 is fixed to piston rods 17 and is shown at a half-stroke position in FIG. 1 and at top dead center in FIG. 2 (i.e. its position closest to the port 7), with its position furthest from the port 7 being commonly referred to as bottom dead center.

In the embodiment shown, the fluid flow control apparatus as defined and as applied to an internal combustion engine is characterized in an advantageous embodiment in that it includes sealing means 18 which are selectively activated in order to provide substantially perfect sealing at piston top dead center or in the vicinity of top dead center, as shown in FIG. 2, or else are deactivated in order to allow fluid to flow freely through said port 7 in order to penetrate into said chamber 30 or to escape therefrom at positions other than top dead center, e.g. as shown in FIG. 1.

In a particularly advantageous embodiment, these sealing means 18 are carried by the piston 15 as shown.

Figure 5:
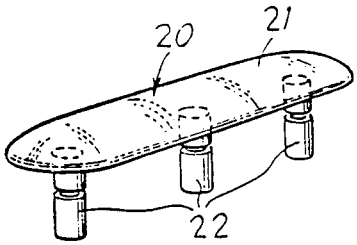
FIG. 5 is a diagrammatic perspective view of the sealing means of the invention constituted in this case by a valve member having three stems, and incorporated in the piston shown in FIGS. 1 to 4.

Advantageously, these sealing means 18 comprise at least one valve member 20 which is shown separately in a perspective view in FIG. 5.

This valve member 20 includes at least one stem 22 (and in this case three stems). The valve member 20 is advantageously mounted to move in translation in a cavity 24 provided in the head of the piston 15, and it is preferably mounted to move in translation therein axially along the axis X—X of the piston 15, and thus along the axis of the treatment chamber 30. Unidirectional thrust means 26 are advantageously disposed in the cavity 24 in order to urge the valve member 20 permanently towards the port 7.

Figure 3:
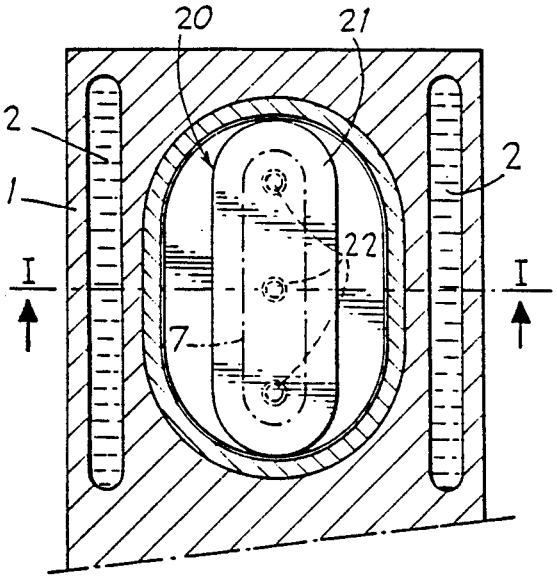
FIG. 3 is a section view on line III—III of FIG. 1.

The size of the port 7 is shown in dot-dashed lines in FIG. 3 together with the active surface area 21 of the valve member 20. It can be seen that in conventional manner this active surface area 21 is larger than the area of the port 7 so as to be capable of providing perfect sealing by pressing the valve member 20 against the sides of the port 7.

Figure 4:
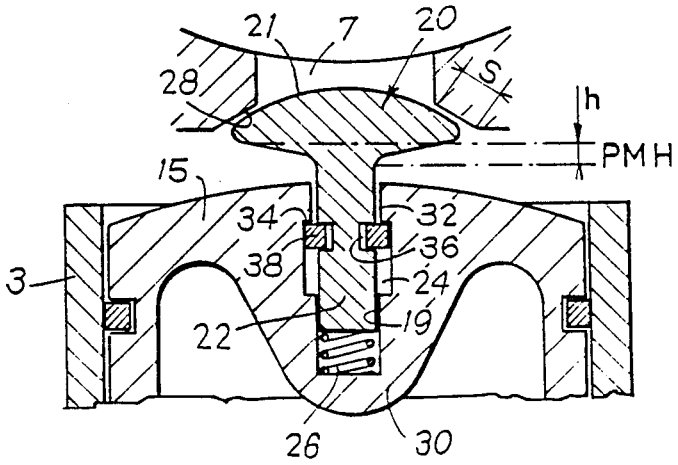
FIG. 4 is a detailed view on a larger scale of the piston at top dead center as shown in FIG. 2, showing the sealing means constituted by a mushroom type valve member in accordance with a preferred embodiment of the invention.

The valve member 20 is preferably a poppet or mushroom type valve member as is clearly visible in FIG. 4. Thus, the active surface 21 of the valve member 20 is convex. This active surface 21 may advantageously co-operate with a bearing surface 28 of annular section S provided in the bottom of the cylinder head 4 around the port 7 so as to provide perfect sealing between the valve member 20 and the sides of the port 7 preventing the flow of any fluid between the treatment chamber 30 and the port 7.

In order to place the valve member 20 in the cavity 24 in the piston 15, the piston 15 includes an inward bulge 50 in which the, or each, cavity 24 is formed for receiving the, or each, stem 22 of the valve member 20. This cavity includes an access orifice 32 which is of smaller section than the general section of the cavity 24 so as to define an annular stop shoulder 34. In addition, each stem 22 of the valve member 20 is provided with an annular groove 36 for receiving a conventional segment 38 which is compressed in order to enable the valve member 20 to be inserted in the cavity 24. Once the small section orifice 32 has been passed, the segment 38 expands and locks the stem 22 in the cavity 24, with said segment 38 normally being permanently urged against the stop shoulder 34 by unidirectional thrust means 26 disposed beneath the stem 22, as shown in FIG. 4. In this position, the valve member 20 is capable of performing axial displacement away from the port 7 over an axial stroke of height h.

Further, the, or each, stem 22 is designed so that the valve member 20 engages the bearing surface 28 of the bottom cylinder head 4 before the piston 15 reaches top dead center, and advantageously, as is easily understood, at the moment when the piston 15 is at a distance h from top dead center.

Thus, it will be understood that when the piston 15 moves towards top dead center, the valve member 20 is in abutment against the surface 28 and closes the port 7, while the piston 15 continues to rise a little through the distance h and firmly locks the valve member 20 against the surface 28 which constitutes a kind of seat therefor, and this continues through top dead center until the piston 15 has gone back down away from top dead center through the same distance h.

When using discontinuous rotary fluid flow control by means of a Maltese cross as described in the Applicant's prior applications FR-No. 86-13 525 and FR-No. 86-17 438, this period corresponds to a period during which the rotary element 13 turns through one fourth of a revolution.

It will thus be understood that at top dead center and in the vicinity of top dead center the combustion chamber is completely sealed with the thrust applied to the valve member 20 being obtained by compressing the unidirectional thrust means 26 (e.g. springs) which are activated by the displacement of the piston towards the port 7. It will thus be understood that all of the previously specified unexpected and determining technical advantages are obtained.

Further, if the engine in question is a four stroke engine, each cycle (two revolutions of the crank shaft) includes two top dead center occasions where sealing is essential. After the admission cycle there is the compression cycle for which perfect sealing is required at top dead center because of the compression ratio which is very high, particularly in diesel engines having a compression ratio of 20 to 25.

This sealing must be maintained at the moment of ignition (however ignition may be achieved) at the precise moment when the shock wave arrives, which is very short in time but which gives rise to a compression ratio that is very high, rising to as much as 100 to 150 times the compression ratio of the engine. The expansion cycle then follows during which the valve member returns to its original position.

This expansion cycle is followed by the exhaust cycle and again, at the end of exhaust, the same valve member 20 reestablishes perfect sealing after the gases have been expelled. It is at this particular moment that the fluid flow control element 13 moves into the admission position as shown in FIG. 1, and the total sealing produced during this short period of time between exhaust and admission ensures that there is no risk of exhaust gases being delivered to the admission circuit.

This can be clearly seen in FIG. 1 where it can be observed that during the admission cycle the head of the piston 15 is going down and the valve member 20 is as far away as possible from the head of the piston 15 since it is urged by the unidirectional thrust means 26, whereas in FIG. 2 which shows the compression cycle, it can be seen that the piston is at top dead center and the valve member 20 completely closes the port 7 while compressing the unidirectional thrust means 26, with the distance of the head of the valve member 20 from the head of the piston 15 varying between top dead center and the remainder of the stroke of the piston 15 by the height h shown in FIG. 4.

It may also be observed that such a fluid flow control apparatus fitted with the above-described sealing means 18 makes it possible to implement the above-defined fluid flow control method and is particularly suitable for use in internal combustion engines regardless of whether they are two stroke or four stroke, or fueled by gasoline or by diesel, and in particular for engines having rotary fluid flow control with a treatment chamber that is oval in section, together with an oval section piston. Another advantageous application relates to piston compressors, and another application concerns equipment that operates by pulses, in particular pulse jets.

The invention also extends to the sealing means 18 as a novel industrial produce, and in particular the valve member 20, and also to pistons 15 fitted with such sealing means.

It should be observed that the sealing means 18, in particular the valve member 20 as shown in the drawings, either on their own or mounted on pistons 15, form an integral part of the invention and are thus fully integrated in the present description.

I claim:

1. A method for providing a sealing means to control the forced flow of a fluid in a structure having at least one admission duct, at least one exhaust duct, a treatment chamber with at least one port communicating selectively with the admission duct and the exhaust duct, and a piston reciprocating in the treatment chamber between a bottom dead center position and a top dead center position, said method comprising the steps of:

(a) providing a suitable sealing means in controlled relation to said piston for insuring substantially perfect sealing between said port and said treatment chamber when said piston is in the immediate vicinity of said top dead center position;

(b) activating said sealing means at an appropriate moment for insuring sealing between said port and said treatment chamber when said piston is in the immediate vicinity of top dead center position; and (c) deactivating said sealing means when said piston is in a position other than in the immediate vicinity of top dead center position, in order to allow said fluid to pass through said port.

2. A method according to claim 1, and activating said sealing means immediately before said piston reaches top dead center position, and deactivating said sealing means immediately after said piston leaves said top dead center position.

3. A method according to claim 1, and moving said sealing means toward and away from said port with the piston.

4. A method according to claim 1, and providing said sealing means in the form of a mushroom shaped valve member.

5. Method according to claim 1, and practicing said method within an engine of at least two strokes.

6. Method according to claim 1, and practicing said method within a piston compressor.

7. Method according to claim 1, and practicing said method within pulse-operated equipment.

8. An apparatus for controlling the forced flow of a fluid in a structure having at least one admission duct, at least one exhaust duct and a treatment chamber under compression, comprising:

(a) a treatment chamber having at least one port communicating selectively with the admission duct and the exhaust duct;

(b) a piston reciprocating in said chamber between a bottom dead center position and a top dead center position;

(c) a sealing means disposed in controlled relation to said piston and constructed and arranged to be selectively activated to ensure substantially perfect sealing between said port and said treatment chamber when said piston is in the immediate vicinity of its top dead center position in order to preclude passage of fluid therethrough; and (d) said sealing means being constructed and arranged to be deactivated when said piston is in a position other than in the immediate vicinity of its top dead center position in order to allow the fluid to pass freely through said port when entering and leaving said treatment chamber.

9. Apparatus according to claim 8, wherein said sealing means is carried by the piston.

10. Apparatus according to claim 8, wherein said sealing means comprises a mushroom shape valve member.

11. Apparatus according to claim 10, wherein said piston has a head portion with a cavity therein, said valve member including at least one stem which is movably mounted within said cavity and constructed and arranged to move axially relative to said piston, said cavity having a unidirectional thrust means disposed therein for biasing said valve member towards said port.

12. Apparatus according to claim 11, wherein said head portion of said piston includes an enlarged inwardly projecting lobe which supports said cavity that receives said stem of said valve member therein.

13. Apparatus according to claim 8, wherein said sealing means is made of structural composite ceramic in the form of a matrix reinforced by fibers directed in at least one of three dimensions.

14. Apparatus according to claim 13, wherein said matrix is made of a substance selected from the group consisting of: zirconia; alumina; a mixture of aluminum oxide and silicon oxide; silicon carbide; graphite; and carbon.

15. Apparatus according to claim 13, wherein said fibers are made of a substance selected from a group consisting of: silicon carbide; zirconia; alumina; a mixture of aluminum oxide and silicon oxide; silicon carbide; a mixture of carbide silicon and titanium carbide; boron; and carbon.

16. Apparatus according to claim 8, wherein said treatment chamber, said port, said piston and said sealing means are ovalshaped in cross section, said sealing means having an active surface area which is larger than the cross-sectional dimensions of said port.

17. Apparatus according to claim 8, wherein said sealing means has active surface area which is larger the cross-sectional dimensions of said port.

18. Apparatus according to claim 17, wherein said port has a flat extending therearound and said active surface of said sealing means bears against said flat so as to provide perfect sealing on contact between said active surface of said sealing means and the surrounding flat of said port.

19. Apparatus according to claim 8, and an engine of at least two strokes in which said chamber, piston and sealing means are contained.

20. Apparatus according to claim 8, and a piston compressor in which said chamber, piston, and sealing means are contained.

21. Apparatus according to claim 8, and a pulse-operated apparatus in which said chamber, piston, and sealing means are contained.

* * * * *